US009033026B2

(12) United States Patent
Persson

(10) Patent No.: US 9,033,026 B2
(45) Date of Patent: May 19, 2015

(54) DOUBLE PLATE HEAT EXCHANGER

(75) Inventor: Lars Persson, Guizhou (CN)

(73) Assignees: Danfoss A/S, Nordborg (DK); EP Technology AB, Malmo (SE)

( * ) Notice: Subject to any disclaimer, the term of this patent is extended or adjusted under 35 U.S.C. 154(b) by 716 days.

(21) Appl. No.: 12/921,614

(22) PCT Filed: Mar. 12, 2009

(86) PCT No.: PCT/DK2009/000065

§ 371 (c)(1),
(2), (4) Date: Dec. 22, 2010

(87) PCT Pub. No.: WO2009/112031

PCT Pub. Date: Sep. 17, 2009

(65) Prior Publication Data

US 2011/0088882 A1 Apr. 21, 2011

(30) Foreign Application Priority Data

Mar. 13, 2008 (DK) ..... 2008 00387

(51) Int. Cl.
*F28F 3/00* (2006.01)
*F28D 9/00* (2006.01)
(Continued)

(52) U.S. Cl.
CPC ..... *F28D 9/005* (2013.01); *Y10T 29/49366* (2015.01); *F28F 3/046* (2013.01)

(58) Field of Classification Search
CPC ..... F28F 3/005; F28F 3/042; F28F 3/044; F28F 3/046; F28F 3/10; F28F 3/12; F28F 2265/06; F28D 1/0308; F28D 1/0375; F28D 9/0031; F28D 9/0037; F28D 9/005; Y10T 29/49366
USPC ..... 165/70, 165, 166, 167, 170
See application file for complete search history.

(56) References Cited

U.S. PATENT DOCUMENTS 4,249,597 A * 2/1981 Carey ..... 165/166
4,915,165 A * 4/1990 Dahlgren et al. ..... 165/166
(Continued)

FOREIGN PATENT DOCUMENTS

DE 41 00 651 A1 7/1992
EP 1 394 491 A2 3/2004
(Continued)

OTHER PUBLICATIONS

International Search Report for Serial No. PCT/DK2009/000065 dated Sep. 28, 2009.

*Primary Examiner* — Tho V Duong
(74) *Attorney, Agent, or Firm* — McCormick, Paulding & Huber LLP

(57) ABSTRACT

A plate heat exchanger (10) of the double plate type having a plurality of stacked plate elements, each comprising a first plate (1) and a second plate (9). At least the first plate (1) is provided with a surface pattern with a plurality of dimples (5) defining a first distance to a plate plane (8), and a plurality of canal parts (6) defining a second, smaller, distance to the plate plane (8). The first plate (1) and the second plate (9) are joined in such a manner that the protruding areas (5, 6) in combination form flow paths (11) being fluidly connected to rim portions (3) of the plates (1, 9). The heat exchanger (10) provides efficient leakage detection via the flow paths (11) while ensuring a good thermal contact between heat exchanging fluids through the plates (1, 9) via flat portions (7) between the protruding parts (5, 6).

13 Claims, 3 Drawing Sheets

(51) Int. Cl.
*F28F 3/04* (2006.01)
*F28F 3/08* (2006.01)

(56) References Cited

U.S. PATENT DOCUMENTS 4,976,313 A * 12/1990 Dahlgren et al. ..... 165/167
5,178,207 A * 1/1993 Bergqvist et al. ..... 165/70
5,291,945 A 3/1994 Blomgren et al.
5,487,424 A * 1/1996 Davison ..... 165/166
5,909,766 A * 6/1999 Kobayashi et al. ..... 165/70
5,913,361 A 6/1999 Engstrom et al.
6,016,865 A * 1/2000 Blomgren ..... 165/148
6,019,160 A * 2/2000 Chen ..... 165/10
6,662,862 B1 * 12/2003 Lindholm ..... 165/166
6,911,631 B2 * 6/2005 Nilsson et al. ..... 219/530
2007/0221366 A1 * 9/2007 Murayama et al. ..... 165/166

FOREIGN PATENT DOCUMENTS

WO 88/08508 A1 11/1988
WO 93/00563 A1 1/1993
WO 2007/012874 A1 2/2007

* cited by examiner

DOUBLE PLATE HEAT EXCHANGER

CROSS REFERENCE TO RELATED APPLICATIONS

This application is entitled to the benefit of and incorporates by reference essential subject matter disclosed in International Patent Application No. PCT/DK2009/000065 filed on Mar. 12, 2009 and Danish Patent Application No. PA 2008 00387 filed Mar. 13, 2008.

FIELD OF THE INVENTION

The present invention relates to plate heat exchangers of the kind having double plates. More specifically the present invention relates to double plate heat exchangers in which a leak may be detected easier than in similar prior art double plate heat exchangers, and in which an improved thermal contact between heat exchanging fluids is obtained. Furthermore, the plate heat exchanger of the present invention is suitable for being produced using high speed production technology, e.g. applying no other production steps than pressing.

BACKGROUND OF THE INVENTION

A plate heat exchanger exchanges heat between two or more fluids. In most plate heat exchangers a number of stacked plate elements separate the fluids, each plate element having a central heat transferring part and a surrounding edge part. In some cases particular care must be taken to avoid one heat exchanging fluid from leaking into the flow way of another heat exchanging fluid. This is, e.g., the case in heat exchangers which are used for heating or cooling potable fluids using non-potable fluids, in heat exchangers used for processing critical fluids, and in heat exchangers in which mixing of the two fluids would result in undesired chemical reactions. In these cases a heat exchanger of the double wall type is normally used. In double wall heat exchangers the plate elements separating the heat exchanging fluids each comprises two plates which are joined together. For brazed heat exchanger brazing of some areas must be avoided.

In order to be able to detect a leak in one of the plates, the plates are often joined together in such a manner that leaking fluid is allowed to flow between the plates towards the edge portion of the plate element, e.g. to a location where it can be detected. Fast detection of a leak requires that the plates are arranged with a sufficient spacing to allow leaking fluid to flow easily towards the detecting position. On the other hand, in order to provide sufficient efficiency in heat transfer between the heat exchanging fluids, it is desirable to arrange the plates as close to each other as possible. Accordingly, various attempts have previously been done to design double wall heat exchangers taking these two requirements into consideration.

U.S. Pat. No. 5,291,945 discloses one example of a double wall heat exchanger comprising a number of plate elements defining flow spaces between them. Each plate element comprises two nested plates which are pressed substantially to the same shape and which closely abut against each other but still admit a heat exchanging fluid leaking through a hole in one of the plates to be conducted between the plates to the edge portion of the plate element. A disadvantage of this heat exchanger is that the time elapsing from a leak occurs until leaking fluid is detected at the edge portion is relatively long due to the plates abutting closely against each other.

U.S. Pat. No. 6,662,862 discloses another example of a heat exchanger in which adjacent plates form a double wall plate unit. Ridges and valleys formed in one plate are arranged adapted to and in near contact with corresponding ridges and valleys of the other plate, except at certain points which are adapted to be arranged in contact with an adjacent double wall plate unit. At these points the plates of the double wall plate unit are arranged with a distance there between in order to avoid unwanted brazing material between the plates of the double wall plate unit, since this would introduce the risk of blocking the flow path formed between the plates, thereby preventing a possible leak from being detected.

SUMMARY OF THE INVENTION

It is an object of the invention to provide a double wall heat exchanger in which a possible leak can be detected faster than in similar prior art heat exchangers.

It is a further object of the invention to provide a double wall heat exchanger in which the heat transfer, in particular in terms of efficiency/kg, between heat exchanging fluids is improved as compared to similar prior art heat exchangers.

It is an even further object of the invention to provide a double wall heat exchanger in which the pressure loss of the heat exchanging fluids during operation is reduced as compared to similar prior art heat exchangers.

It is an even further object of the invention to provide a double wall heat exchanger which can be produced more cost effectively and in a more efficient production way than similar prior art heat exchangers.

It is an even further object of the invention to provide a double wall heat exchanger which can be produced with thinner material than similar prior art heat exchangers, while maintaining or even improving the strength of the heat exchanger.

According to a first aspect of the invention the above and other objects are fulfilled by providing a plate heat exchanger comprising a stack of plate elements forming flow paths for at least two heat exchanging fluids, each plate element being of a double wall construction comprising a first plate and a second plate, each of the first and second plates comprising a rim portion and a central heat exchanging portion, wherein:

- the central heat exchanging portion of the first plate is provided with a first surface pattern with a plurality of first protruding areas defining a first distance from a plate plane of the first plate, and a plurality of second protruding areas defining a second distance from said plate plane, said second distance being smaller than said first distance, and
- the first plate and the second plate are joined in such a manner that the protruding areas in combination form flow paths arranged between the first plate and the second plate, the flow paths being fluidly connected to the rim portions of the plates.

The plate elements are of a double wall construction, i.e. each plate element comprises two plates which are joined together as described above. Accordingly, the plate heat exchanger of the invention is suitable for use in applications where it is important to avoid cross-contamination between the heat exchanging fluids.

Each of the plates comprises a rim portion and a central heat exchanging portion. The rim portion is arranged substantially circumferentially around the central heat exchanging portion. The heat transfer between the heat exchanging fluids takes place via the central heat exchanging portions of the plates.

The rim portion is fluidly connected to the surroundings. Thus, leaking fluid flowing via the flow paths will eventually leave the heat exchanger via the rim portion, thereby allowing visual detection of a leak. The rim portion may be completely open, i.e. the full rim portion may fluidly communicate with the surroundings. In this case a leak will be detectable at the position where a relevant flow path reaches the rim portion. Alternatively, the rim portion may be or comprise one or more flow channels each being provided with one or more openings providing fluid communication to the surroundings. Each of the flow paths arranged between the first plate and the second plate is then fluidly connected to at least one of the flow channels of the rim portion. In this case a possible leak is visually detectable at the position of one of the openings.

The central heat exchanging portion of the first plate is provided with a first surface pattern. The first surface pattern has a plurality of first protruding areas and a plurality of second protruding areas. The first protruding areas define a first distance from a plate plane and the second protruding areas define a second distance from the plate plane, the second distance being smaller than the first distance. Thus, the first surface pattern comprises two kinds of protruding areas, protruding to two distinct distances from the plate plane.

The first plate and the second plate are joined in such a manner that the protruding areas in combination form flow paths. The flow paths are fluidly connected to the rim portions of the plates. Thereby, in the case that a leak occurs in one of the plates at a position which is at least partly overlapping with a protruding area, leaking fluid is allowed to flow to the rim portions of the plates via one or more of the flow paths, thereby allowing the leak to be detected.

Simultaneously, the parts of the first plate which are not protruding areas can be arranged in close contact with the second plate, thereby providing good thermal contact between heat exchanging fluids flowing along opposing sides of the plate element. The first plate and the second plate may even be brazed together at positions corresponding to these parts, thereby improving the heat transfer between the heat exchanging fluids.

Thus, the plate heat exchanger of the invention ensures that a possible leak can be promptly detected, without compromising, or even while improving, the heat transfer between the heat exchanging fluids.

Furthermore, the fact that the first protruding parts and the second protruding parts define two distinct distances from the plate plane of the first plate, allows heat exchanging fluids to flow directly along the entire length and/or width of the heat exchanger because the fluids will be able to flow along the areas defined by the second protruding areas. Thereby the pressure loss of the heat exchanging fluids across the plate heat exchanger can be minimised. This is an advantage because a high pressure at the end user is thereby maintained in the case that the heat exchanger is used in a water supply system, such as a district heating system. In the case that the heat exchanger is used in a cooling circuit or a heat pump circuit, the required work of the pump is reduced. Thus, the flow speed can be increased in the channels, thereby making the heat transfer better with same or lower pressure drop.

The first protruding areas may advantageously be in the form of a plurality of dimples arranged in a desired pattern on the first plate, and the second protruding areas may be in the form of channels, each interconnecting two or more dimples.

The central heat exchanging part of the second plate may also be provided with a surface pattern, e.g. substantially identical to the surface pattern of the first plate, or a different surface pattern. As an alternative, the second plate may be substantially flat, in which case the flow paths arranged between the plates are defined solely by means of the protruding areas of the first surface pattern. This will be described in further detail below.

The protruding areas may form a herring bone pattern. According to this embodiment adjacent plate elements may advantageously be arranged in such a manner that neighbouring plate elements are rotated 180° relatively to each other in the sense that the herring bone patterns of adjacent plate elements are inclined in opposite directions. Thereby the protruding areas define a space between the plate elements in which a heat exchanging fluid can flow. However, since the first protruding areas extend a further distance from the plate plane of the first plate than the second protruding parts, heat exchanging fluid will be allowed to cross the part of the herring bone pattern which is constituted by the second protruding parts, and thereby the pressure loss of the heat exchanger is reduced as compared to prior art plate heat exchangers having a herring bone surface pattern.

The first plate and the second plate may advantageously be joined using a brazing technique. According to this embodiment brazing material, such as copper, copper nickel, nickel or other suitable brazing materials, preferably in the form of a thin sheet, is arranged between the first plate and the second plate at selected positions. When the heat exchanger has been assembled it is heated, preferably in a suitable oven, to a temperature which is sufficient to liquefy the brazing material, and the plates are thereby brazed together. It should be understood that this process is carried out in such a manner that the flow paths formed between the plates are not blocked. This will be described further below.

As an alternative, the first plate and the second plate may be joined together using other techniques, e.g. gluing.

The first plate and the second plate may be brazed together in areas which are not protruding areas. According to this embodiment, parts of the first plate and the second plate which are arranged substantially in plate planes defined by the plates are joined by brazing material. Thereby it is ensured that the plates are kept firmly together in these areas, thereby providing good thermal contact between heat exchanging fluids flowing on opposite sides of the plate element. Furthermore, the brazing material itself typically further improves the heat transfer. Thus, according to this embodiment, a heat exchanger is provided in which the heat transfer between the heat exchanging fluids is substantially improved as compared to similar prior art heat exchangers.

It should be noted that the size and shape of the protruding areas should be designed in such a manner that brazing material does not enter and block the flow paths formed by the protruding areas.

The combined area of protruding areas may constitute at most 80% of the total area of the first plate, such as within the interval 20%-50%, such as approximately 40%. It should noted that the flow paths should be minimized but must be large enough to avoid capillary brazing, i.e. to avoid that brazing material enter the flow channels, thereby blocking them.

According to this embodiment it is ensured that sufficient heat transfer can take place via the non-protruding areas of the plates.

The first distance, i.e. the distance from the plate plane of the first plate being defined by the first protruding areas, may be within the interval 0.2 mm-3 mm, such as within the interval 0.4 mm-2 mm, such as within the interval 0.5 mm-1 mm, such as approximately 0.6 mm. Since the first distance in many cases defines the distance between neighbouring plate elements, and thereby the dimensions of the flow paths for the heat exchanging fluids, the first distance will be determined by the desirable dimensions of these flow paths, and thereby by the intended application.

Alternatively or additionally, the second distance, i.e. the distance from the plate plane of the first plate being defined by the second protruding areas, may be within the interval 0.1 mm-2.5 mm, such as within the interval 0.2 mm-2 mm, such as within the interval 0.25 mm-1 mm, such as within the interval 0.3 mm-0.5 mm, such as approximately 0.4 mm. The distance will, however, depend on the size of the heat exchanger and the design pressure drop across the heat exchanger.

It should be noted that the first distance as well as the second distance should preferably be sufficiently large to ensure that brazing material will not enter and block the flow paths defined by the protruding areas, thereby potentially preventing efficient detection of leaks.

The first protruding areas may be arranged in a substantially hexagonal pattern on the first plate. Arranging the first protruding areas in this manner has the advantage that the distance between neighbouring first protruding areas can be minimised while optimising the area of the plate element which is not protruding, i.e. the area which is actually transferring heat. Thereby it is ensured that a leak of a predefined minimum size corresponding to the distance between neighbouring first protruding areas can be detected, while at the same time optimising the heat transfer between the heat exchanging fluids.

The first protruding parts may advantageously be arranged with mutual angles within the interval 110°-145°, such as approximately 120°.

As mentioned above, the first protruding areas may advantageously be in the form of dimples and the second protruding areas may be in the form of channels interconnecting the dimples. In a preferred embodiment, such dimples may be arranged in a substantially hexagonal pattern, while the channels interconnect the dimples in such a manner that herring bone pattern is formed.

The average distance between two neighbouring first protruding areas may be within the interval 0.5 mm-5 mm, such as within the interval 0.7 mm-4 mm, such as within the interval 1 mm-3 mm, such as approximately 1.9 mm or approximately 2.9 mm. As mentioned above, the average distance between two neighbouring first protruding parts may be used as a measure for the smallest detectable leaks. It is a standard legislative requirement in many countries that leaks having a diameter which is larger than 2 mm must be detectable in double wall heat exchangers. Arranging the first protruding areas in such a manner that their mutual distance does not exceed 2 mm will ensure that this requirement is fulfilled, since a leak having a diameter which is larger than 2 mm must overlap with at least one of the first protruding areas, and thereby fluid leaking from the leak enters a flow path defined by the protruding areas and is led to the rim portion where it can be detected.

The central heat exchanging portion of the second plate may be provided with a surface pattern with a plurality of third protruding areas defining a third distance from a plate plane of the second plate, and a plurality of fourth protruding areas defining a fourth distance from said plate plane, said fourth distance being smaller than said third distance.

According to this embodiment, the first plate as well as the second plate is provided with a surface pattern of protruding areas defining distinct distances from a plate plane of the relevant plate. The protruding parts of the first plate and the protruding parts of the second plate preferably cooperate in forming the flow paths between the plates.

As an alternative, the second plate may be substantially plane.

The first plate and the second plate may be joined in such a manner that the first protruding areas are arranged at positions corresponding to the third protruding areas and the second protruding areas are arranged at positions corresponding to the fourth protruding areas, the protruding areas of the first plate protruding in a substantially opposite direction as compared to the protruding areas of the second plate, and in such a manner that the protruding areas in combination form flow paths being fluidly connected to the rim portions of the plates.

According to this embodiment, the second plate is substantially a mirror image of the first plate. This makes it very easy to manufacture the heat exchanger.

The third protruding areas may be arranged in a substantially hexagonal pattern on the second plate. The remarks set forth above regarding the first protruding areas being arranged in a substantially hexagonal pattern are equally applicable here.

The heat exchanger may further be provided with additional leakage protection at positions near the inlets/outlets of the heat exchanging fluids. Such leakage protection may advantageously be in the form of a separation zone, e.g. created by a separation groove arranged around each inlet/outlet. Only the heat exchanging fluid which flows into or out of the heat exchanger through the inlet/outlet in question is allowed entry into the separation zone. Within the separation zone a blocked-off space may advantageously be provided, which cannot be reached by any of the heat exchanging fluids under normal operating conditions. Providing the space with a leakage vent which can only be reached by heat exchanging fluid in case of a leak, and by fluidly connecting the leakage vent with the surroundings, leak detection can be performed efficiently. The additional leakage protection may advantageously be of the kind described in EP 0 974 036, the disclosure of which is hereby incorporated by reference.

According to a second aspect of the invention, the above and other objects are fulfilled by providing a method of manufacturing a plate heat exchanger according to the first aspect of the invention, said heat exchanger comprising a plurality of plate elements of a double wall construction, the method comprising the steps of:

- providing a plurality of plates, said plates being pair-wise adapted to form a double wall plate element,
- stacking said plurality of plates with sheets of brazing material arranged between neighbouring plates, and
- heating the stack of plates to a temperature sufficient to liquefy the brazing material.

It should be noted that a skilled person would readily recognise that any feature described in combination with the first aspect of the invention could also be combined with the second aspect of the invention, and vice versa.

The second aspect of the invention relates to a method for manufacturing a plate heat exchanger according to the first aspect of the invention. Accordingly, it should be understood that all the characteristics of the plate heat exchanger described above, including the first surface pattern formed on at least one of the plates of each plate element and the flow paths formed between plates of the plate elements, are also present in the heat exchanger resulting from the method according to the second aspect of the invention.

According to the method, the heat exchanger is manufactured in a very simple manner, i.e. simply by stacking the plates with brazing material between the plates, and subsequently heating the stack of plates in order to liquefy the brazing material, thereby brazing the plates together. Thus, there is no requirement of cumbersome additional manufacturing steps, such as forming the plate elements prior to stacking these, and the number of manufacturing steps is thereby minimised. The specific design of the first surface pattern, notably the first and second protruding areas makes this possible, since these prevent capillary brazing as described above.

The heating step may be performed using an oven, or it may be performed in any other suitable manner.

The brazing material may advantageously be copper. Alternatively, it may be copper nickel, nickel or other suitable brazing materials The step of providing a plurality of plates may comprise pressing at least some of the plates to obtain a first surface pattern with a plurality of first protruding areas defining a first distance from a plate plane, and a plurality of second protruding areas defining a second distance from said plate plane, said second distance being smaller than said first distance. This is a very easy manner of obtaining the desired surface pattern. According to one embodiment only one of the two plates forming a plate element may be pressed to form a surface pattern thereon, the other plate of the element being substantially plane. Alternatively, and preferably, both plates may be pressed to form a surface pattern thereon, and the plate may advantageously be arranged in such a manner that protruding areas protrude in opposite directions as described above.

The first surface pattern may advantageously be provided in a single pressing step, i.e. the entire surface pattern may be obtained in one pressing step.

Alternatively or additionally, the step of providing a plurality of plates may comprise punching at least one inlet opening and at least one outlet opening in each plate. The punching step is preferably performed separately from the pressing step. However, it could also be envisaged that the pressing step and the punching step could be performed in a single step.

BRIEF DESCRIPTION OF THE DRAWINGS

The invention will now be described in further detail with reference to the accompanying drawings in which.

DETAILED DESCRIPTION OF THE PREFERRED EMBODIMENTS

Figure 1:
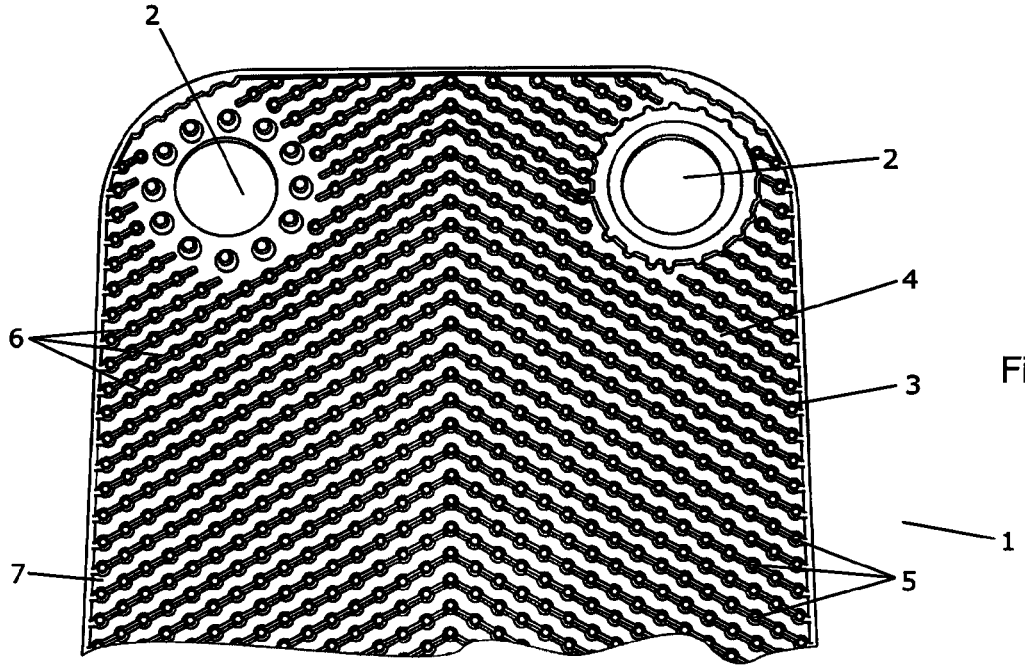
FIG. 1 is a perspective view of a plate for a plate element for a plate heat exchanger according to an embodiment of the invention.

FIG. 1 is a perspective view of a first plate 1 for a plate element for use in a plate heat exchanger according to an embodiment of the invention. The plate 1 is provided with two large openings 2 being adapted to be connected to inlets or outlets for heat exchanging fluids. The plate 1 comprises a rim portion 3 and a central heat exchanging portion 4.

The central heat exchanging portion 4 of the plate 1 is provided with a surface pattern comprising a plurality of dimples 5 arranged in a substantially hexagonal pattern, and a plurality of canal parts 6, each interconnecting two dimples 5 or a dimple 5 and the rim portion 3. The dimples 5 as well as the canal parts 6 protrude from the plate 1 in a direction out of the paper plane. The canal parts 6 are further arranged in such a manner that a herring bone pattern of protruding areas 5, 6 is formed.

During assembly of the heat exchanger the plate 1 is brazed to another plate in order to form a double wall plate element, along the side which is not visible in FIG. 1. The other plate corresponds to the plate 1 shown in FIG. 1 in the sense that it is provided with a similar surface pattern of dimples and canal parts, the dimples and canal parts being arranged at positions corresponding to the positions of the dimples 5 and canal parts 6 of the first plate 1, but protruding in an opposite direction. Thus, the dimples 5 and canal parts 6 of the two plates in combination form flow channels arranged between the plates and each forming a flow path to the rim portion 3. Brazing material is allowed to enter the between the plates at areas 7 which do not correspond to dimples 5 or canal parts 6. Thereby a good heat transfer between heat exchanging fluids flowing on either side of the double wall plate element is obtained. Forming the double plate elements in this manner they can be regarded as a conventional single plate with internal channels. This will be described in further detail below.

The dimples 5 protrude further in the direction out of the paper plane than the canal parts 6. This allows a heat exchanging fluid to pass the areas corresponding to the canal parts 6 when the heat exchanger has been assembled. This will be described in further detail below.

Figure 2:
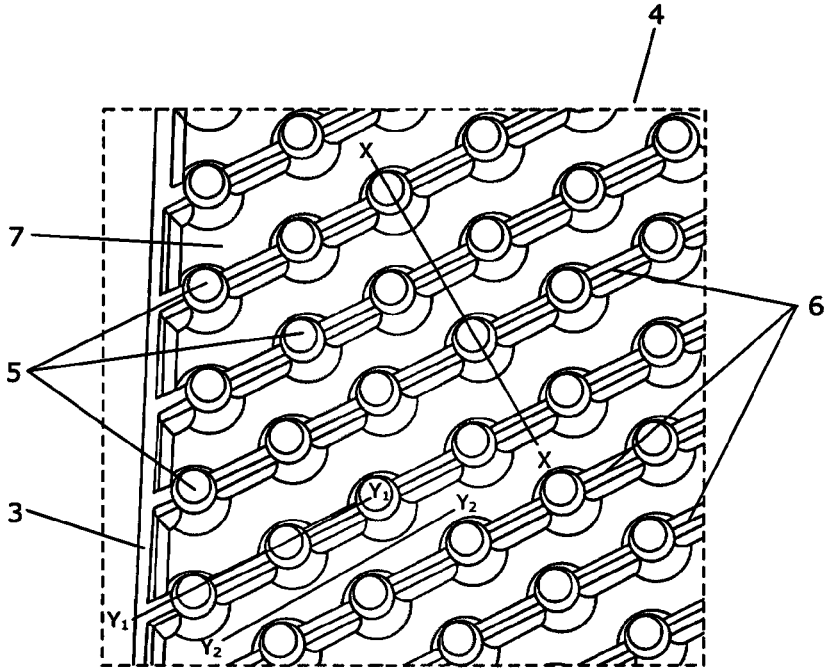
FIG. 2 is a detail of the plate of FIG. 1, FIGS. 3*a* and 3*b* are schematic drawings of the cross section of a first plate for a plate element for a plate heat exchanger according to an embodiment of the invention, along two different directions.

FIG. 2 is a detail of the plate of FIG. 1. From FIG. 2 it is clearly seen that the dimples 5 protrude further in the direction out of the paper than the canal parts 6.

Figure 3A:
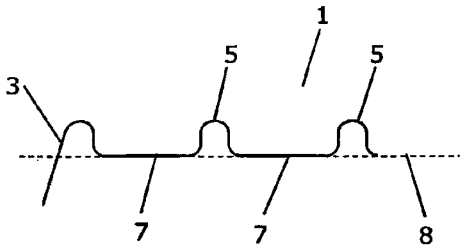
Figure 3B:
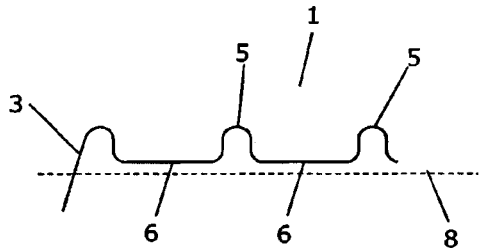

FIGS. 3*a* and 3*b* are schematic drawings of the cross section of a first plate 1 for a plate element for a plate heat exchanger according to an embodiment of the invention. FIG. 3*a* shows the cross section of the plate 1 along a direction which intersects dimples 5 and flat areas 7 of the plate 1, but not canal parts. It can be seen from FIG. 3*a* that the flat areas 7 are substantially flush with a plate plane 8 indicated by a dotted line. The rim portion 3 can also be seen.

FIG. 3*b* shows the cross section of the plate 1 along a direction which intersects dimples 5 as well as canal parts 6. It can be seen from FIG. 3*b* that the canal parts 6 are arranged at a distance from the plate plane 8, and that the dimples 5 protrude further away from the plate plane 8 than the canal parts 6.

Figure 4A:
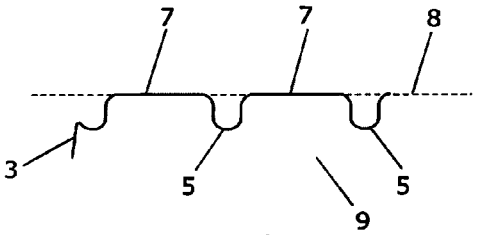
FIGS. 4*a* and 4*b* are schematic drawings of the cross section of a second plate for a plate element for a plate heat exchanger according to an embodiment of the invention, along two different directions.
Figure 4B:
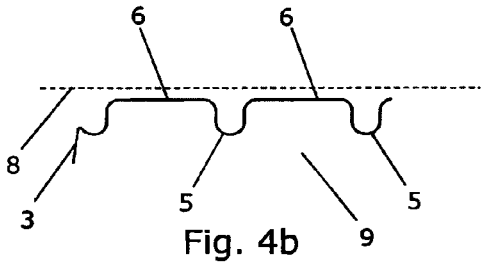

FIGS. 4*a* and 4*b* are schematic drawings of the cross section of a second plate 9 along directions corresponding to the directions shown in FIGS. 3*a* and 3*b*, respectively. Thus, in FIG. 4*a* the direction intersects dimples 5 and flat areas 7, and in FIG. 4*b* the direction intersects dimples 5 and canal parts 6. It can be seen that the dimples 5 and canal parts 6 of the second plate 9 protrude in a direction which is substantially opposite to the direction in which the dimples 5 and canal parts 6 of the first plate 1 protrude. Furthermore, the dimples 5 and canal parts 6 are arranged at corresponding positions of the plates 1, 9. Thus, when the first plate 1 and the second plate 9 are joined, the dimples 5 and canal parts 6 of both plates 1, 9 in combination form flow paths adapted to lead a leaking fluid towards the rim portion 3.

Figure 5:
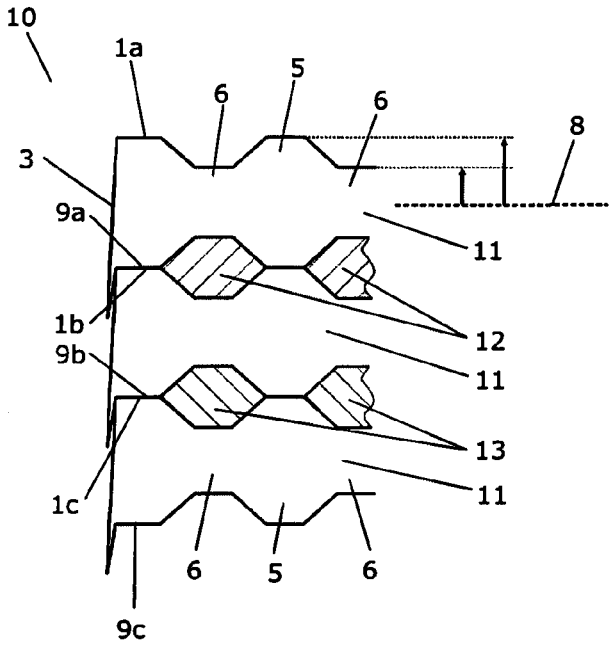
FIG. 5 is a cross sectional view of a plate heat exchanger comprising three plate elements having plates of the kind shown in FIG. 1, taken along line Y1-Y1 shown in FIG. 2.

FIG. 5 is a cross sectional view of a plate heat exchanger 10 comprising three plate elements having plates 1, 9 of the kind shown in FIG. 1, taken along line Y1-Y1 shown in FIG. 2. Plates 1*a* and 9*a* form a first double plate, plates 1*b* and 9*b* form a second double plate, and plates 1*c* and 9*c* form a third double plate. Between the plates 1, 9 of each double plate flow paths 11 are formed. These flow paths 11 are adapted to lead possible leaking fluid towards the rim portion 3 of the plates 1, 9 for detection.

Each double plate is brazed to its neighbouring double plate(s) at positions corresponding to the dimples 5. Further the double plates is orientated 180 degree in a plane parallel to the plates. This is similar to a standard heat exchanger. Thereby first channels 12 for a first heat exchanging fluid and second channels 13 for a second heat exchanging fluid are formed. It is clear that the dimples 5 define a distance to the plate plane 8 which is larger than the distance defined by the canal parts 6. It is also clear from FIG. 5 that the heat exchanging fluids are allowed to pass the flow paths 11 via the areas defined by the canal parts 6. Thereby the pressure loss across the heat exchanger 10 is reduced as compared to similar prior art heat exchanger.

Figure 6:
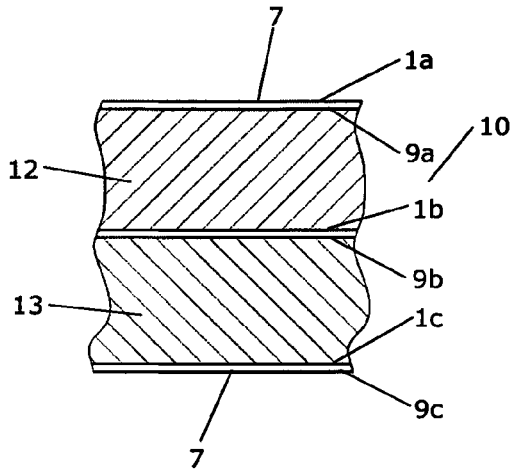
FIG. 6 is a cross sectional view of a plate heat exchanger comprising three plate elements having plates of the kind shown in FIG. 1, taken along line Y2-Y2 shown in FIG. 2.

FIG. 6 is a cross sectional view of the plate heat exchanger 10 shown in FIG. 5, but taken along line Y2-Y2 shown in FIG. 2. Thus, in FIG. 6 the cross section is along a direction which only intersects flat areas 7. It can be seen that the first heat exchanging fluid flowing in the first channels 12 and the second heat exchanging fluid flowing in the second channels 13 are arranged very close to each other along this cross section, thereby providing a good thermal contact between the two fluids, and thereby providing good heat transfer. Furthermore, the plates 1, 9 of each double plate are brazed together in the flat areas 7, thereby even further improving the heat transfer across each double plate.

Figure 7:
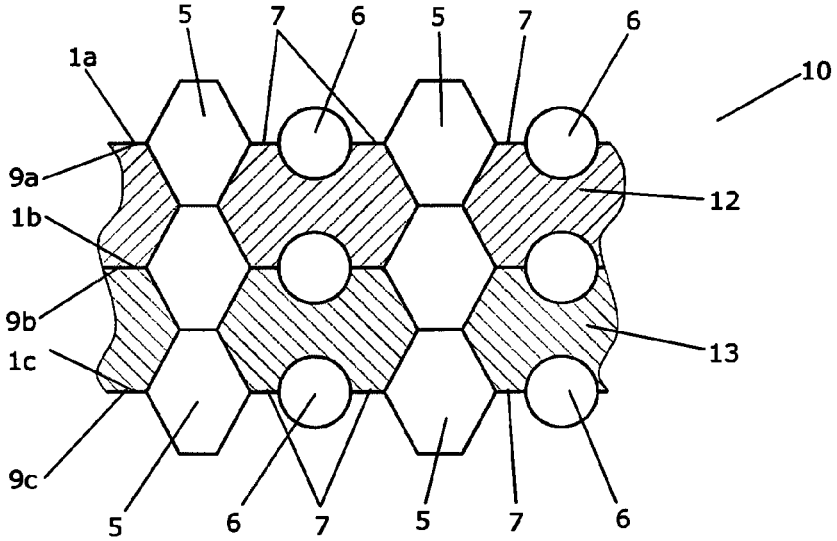
FIG. 7 is a cross sectional view of a plate heat exchanger comprising three plate elements having plates of the kind shown in FIG. 1, taken along line X-X shown in FIG. 2.

FIG. 7 is a cross sectional view of the plate heat exchanger 10 of FIGS. 5 and 6, but taken along line X-X shown in FIG. 2. Thus, in FIG. 7 the cross section is along a direction which intersects dimples 5, canal parts 6 and flat areas 7. It should be noted that the plates 9*a* and 1*b* and the plates 9*b* and 1*c*, respectively, are brazed together at positions corresponding to the dimples 5. Furthermore, the plates 1*a* and 9*a*, 1*b* and 9*b*, and 1*c* and 9*c*, respectively, are brazed together at positions corresponding to the flat areas 7.

Even though FIGS. 5 and 7 are only schematic drawings it is desirable that the dimples 5 and the channel parts 6 have substantially square form as shown in FIGS. 5 and 7. When making them substantially square the canals will not be filled with brazing material during the brazing process ensuring a reliable and good performing heat exchanger.

While the present invention has been illustrated and described with respect to a particular embodiment thereof, it should be appreciated by those of ordinary skill in the art that various modifications to this invention may be made without departing from the spirit and scope of the present.

What is claimed is:

1. A plate heat exchanger comprising a stack of plate elements forming flow paths for at least two heat exchanging fluids, each plate element being of a double wall construction comprising a first plate and a second plate, each of the first and second plates comprising a rim portion and a central heat exchanging portion, wherein:

the central heat exchanging portion is provided with a first surface pattern with a plurality of first protruding areas defining a first distance from a plate plane, and a plurality of second protruding areas defining a second distance from said plate plane, said second distance being smaller than said first distance;

the rim portion comprising a flow channel extending circumferentially around the central heat exchanging portion;

the first plate and the second plate are joined in such a manner that the protruding areas in combination form flow paths arranged between the first plate and the second plate, the flow paths being fluidly connected to the circumferentially extending flow channel of the rim portion of the plates; and the flow paths allow the at least two heat exchanging fluids to flow to the rim portion when leaked from flow channels arranged between the plates.

2. The plate heat exchanger according to claim 1, wherein the protruding areas form a herring bone pattern.

3. The plate heat exchanger according to claim 1, wherein the first plate and the second plate are joined using a brazing technique.

4. The plate heat exchanger according to claim 3, wherein the first plate and the second plate are brazed together in areas which are not protruding areas.

5. The plate heat exchanger according to claim 1, wherein the combined area of protruding areas constitutes at most 80% of the total area of the first plate.

6. The plate heat exchanger according to claim 1, wherein the first distance is within the interval 0.2 mm-3 mm.

7. The plate heat exchanger according to claim 1, wherein the second distance is within the interval 0.1 mm-2.5 mm.

8. The plate heat exchanger according to claim 1, wherein the first protruding areas are configured to form flow paths having hexagonal cross sections.

9. The plate heat exchanger according to claim 1, wherein the average distance between two neighbouring first protruding areas is within the interval 0.5 mm-5 mm.

10. The plate heat exchanger according to claim 1, wherein the central heat exchanging portion of the second plate is provided with a surface pattern with a plurality of third protruding areas defining a third distance from a plate plane of the second plate, and a plurality of fourth protruding areas defining a fourth distance from said plate plane, said fourth distance being smaller than said third distance.

11. The plate heat exchanger according to claim 10, wherein the first plate and the second plate are joined in such a manner that the first protruding areas are arranged at positions corresponding to the third protruding areas and the second protruding areas are arranged at positions corresponding to the fourth protruding areas, the protruding areas of the first plate protruding in a substantially opposite direction as compared to the protruding areas of the second plate, and in such a manner that the protruding areas in combination form flow paths being fluidly connected to the flow channel of the rim portion of the plates.

12. The plate heat exchanger according to claim 10, wherein the third protruding areas are configured to form flow paths having hexagonal cross sections.

13. The plate heat exchanger according to claim 1, wherein the flow channel comprises one or more openings configured to provide fluid communication with an exterior surrounding.

* * * * *